US006160485A

United States Patent [19]

Krakovich

[11] Patent Number: 6,160,485

[45] Date of Patent: Dec. 12, 2000

[54] VOLTAGE LEVEL CONDITIONING TRANSCEIVER CABLE

[75] Inventor: Alex Krakovich, Whitefish Bay, Wis.

[73] Assignee: Applied Systems Engineering, LLC, Whitefish Bay, Wis.

[21] Appl. No.: 09/222,138

[22] Filed: Dec. 29, 1998

[51] Int. Cl.[7] ..... G08B 21/00

[52] U.S. Cl. ..... 340/635; 340/691.1; 439/490

[58] Field of Search ..... 340/635, 654, 340/687, 691.1; 439/490, 502

[56] References Cited

U.S. PATENT DOCUMENTS

| | | | |
|---|---|---|---|
| 4,236,779 | 12/1980 | Tang | 339/143 R |
| 4,775,328 | 10/1988 | McCarthy | 439/211 |
| 4,781,615 | 11/1988 | Davis et al. | 439/395 |
| 5,192,226 | 3/1993 | Wang | 439/502 |
| 5,480,319 | 1/1996 | Vlakancic | 439/347 |
| 5,613,873 | 3/1997 | Bell, Jr. | 439/490 |
| 5,876,240 | 3/1999 | Derstine et al. | 439/490 |
| 5,924,889 | 7/1999 | Wang | 439/490 |

OTHER PUBLICATIONS

B&B Electronics 1998–1999 Catalog, page 4 & cover.

Horner Electric SNP to RS232 Adapter Data Sheet 2 pages.

*Primary Examiner*—Julie Lieu

*Attorney, Agent, or Firm*—Donald J. Ersler

[57] ABSTRACT

A voltage level conditioning transceiver cable includes a a voltage level conditioning circuit, a single ended to differential circuit, a controller connector, a device connector, and a plurality of lines. The voltage level conditioning circuit and the single ended to differential circuit are mounted on a circuit board. The controller connector is attached to one end of the circuit board. One end of a plurality of lines are attached to the other end of the circuit board such that they are disposed substantially parallel to a front of the controller connector. At least one light indication device is attached to the circuit board, such that the light indication device emits light when there is a data transfer between the programmable controller and another device. The circuit board is molded over with the controller connector and plurality of lines. The other end of the plurality of lines are connected to the device connector. The other end of the plurality of lines are molded over with the device connector.

19 Claims, 3 Drawing Sheets

VOLTAGE LEVEL CONDITIONING TRANSCEIVER CABLE

BACKGROUND OF THE INVENTION

1. Field of the Invention

The present invention relates generally to cables and more specifically to a voltage level conditioning transceiver cable which provides communication between RS-232 and RS-485/RS-422 serial communication ports.

2. Discussion of the Prior Art

There are several brands of programmable controllers which have RS-485/RS-422 serial communication ports. Various communications interface standards are known for establishing communications between computer systems and programmable controllers. One example of such an interface is the RS-232 serial communications interface standard which is used in many applications including IBM compatible personal computers. Interfacing a programmable controller with an RS-485/RS-422 port to a peripheral piece of equipment with an RS-232 port requires the use of an in-line device. The in-line device converts the RS-232 single ended signals to an RS-485/RS-422 differential signal. The only product commercially available to the applicant's knowledge is an adapter manufactured by Horner Electric of Indianapolis, Ind. The RS-485/RS-422 end of the Horner adapter is plugged into a programmable controller. The other end of the Horner adapter contains a 9 pin connector which is RS-232 compatible. One end of the 9-pin cable is then plugged into the RS-232 connector of the Horner adapter. The other end of the 9-pin cable is then plugged into another device such as a personal computer. If the device is a modem or an operator interface terminal, the correct 9-pin to 25-pin adapter must be used to provide the proper signal connections.

Unfortunately, the Horner adapter has some drawbacks. First, NEMA standards require that programmable controllers be contained in sealed enclosures. The straight in-line design of the Horner adapter requires the programmable controller to be placed in a sealed enclosure which is approximately 4 inches deeper than necessary. Second, the Horner adapter does not have any type of indication that communication is occurring between the programmable controller and another device. Third, the Horner controller may be damaged from moisture, because the circuit is retained in a non-sealed plastic enclosure.

Fourth, the Horner controller has at least three individual connections which increase the likelihood of improper connections or possible physical damage due to signals being shorted to ground. If the device is not pin for pin compatible with the Horner adapter, a null modem adapter may be required which would increase the individual connections to five. The use of the null modem adapter could also require an even deeper enclosure to be used to contain the programmable controller.

Accordingly, there is a clearly felt need in the art for a voltage conditioning transceiver cable which allows connection to a programmable controller disposed in a tight space, provides monitoring of data transfers, and has the electrical circuitry molded as an integral part of the cable.

SUMMARY OF THE INVENTION

The primary objective of the present invention is to provide a voltage conditioning transceiver cable which allows connection to a programmable controller disposed in a tight space, provides monitoring of data transfers, and has the electrical circuitry molded as an integral part of the cable.

According to the present invention, a voltage level conditioning transceiver cable includes a voltage level conditioning circuit, a single ended to differential circuit, a controller connector, a device connector, and a plurality of lines. The voltage level conditioning circuit and the single ended to differential circuit are mounted on a circuit board. The controller connector is attached to one end of the circuit board. One end of a plurality of lines are attached to the other end of the circuit board such that they are disposed substantially parallel to a front of the controller connector. At least one light indication device is attached to the circuit board, such that the light indication device emits light when there is a data transfer between the programmable controller and another device. The circuit board, controller connector and plurality of lines are encapsulated in plastic. The other end of the plurality of lines are connected to the device connector. The other end of the plurality of lines and the device connector are encapsulated in plastic. The plastic molding of each end of the voltage level conditioning transceiver cable protects it from damage and moisture.

Accordingly, it is an object of the present invention to provide a voltage level conditioning transceiver cable which has the cable molded parallel to a front of one of the controller connector.

It is a further object of the present invention to provide a voltage level conditioning transceiver cable which has the circuit board molded as an integral part of the cable.

It is yet another object of the present invention to provide a voltage level conditioning transceiver cable which provides a minimal amount of connections between a programmable controller and another device.

Finally, it is yet a further object of the present invention to provide a voltage level conditioning transceiver cable which has at least one light indication device that emits light when data is being transferred between a programmable controller and another device.

These and additional objects, advantages, features and benefits of the present invention will become apparent from the following specification.

DETAILED DESCRIPTION OF THE PREFERRED EMBODIMENTS

Figure 1:
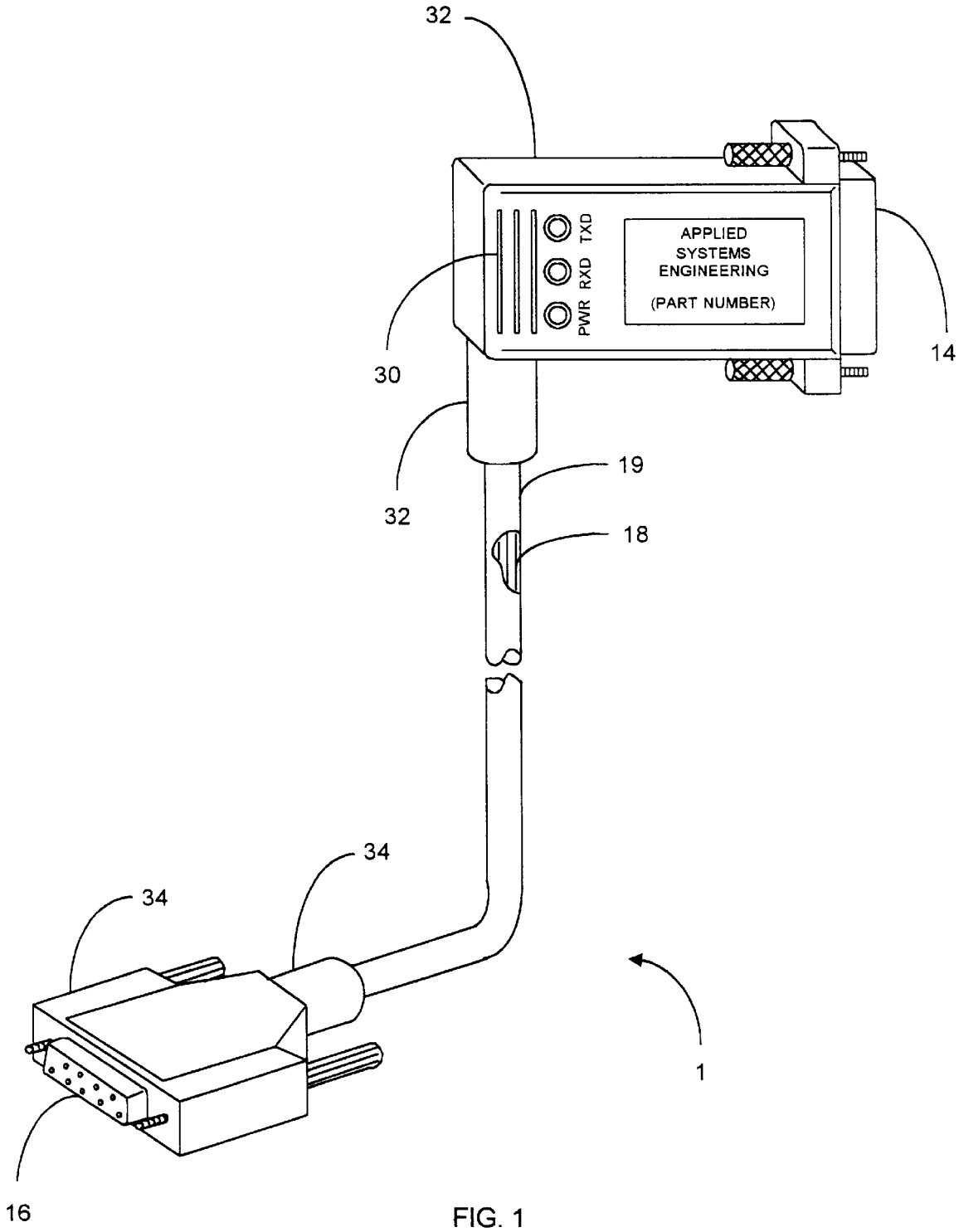
FIG. 1 is a perspective view of the voltage level conditioning transceiver cable in accordance with the present invention.
Figure 2:
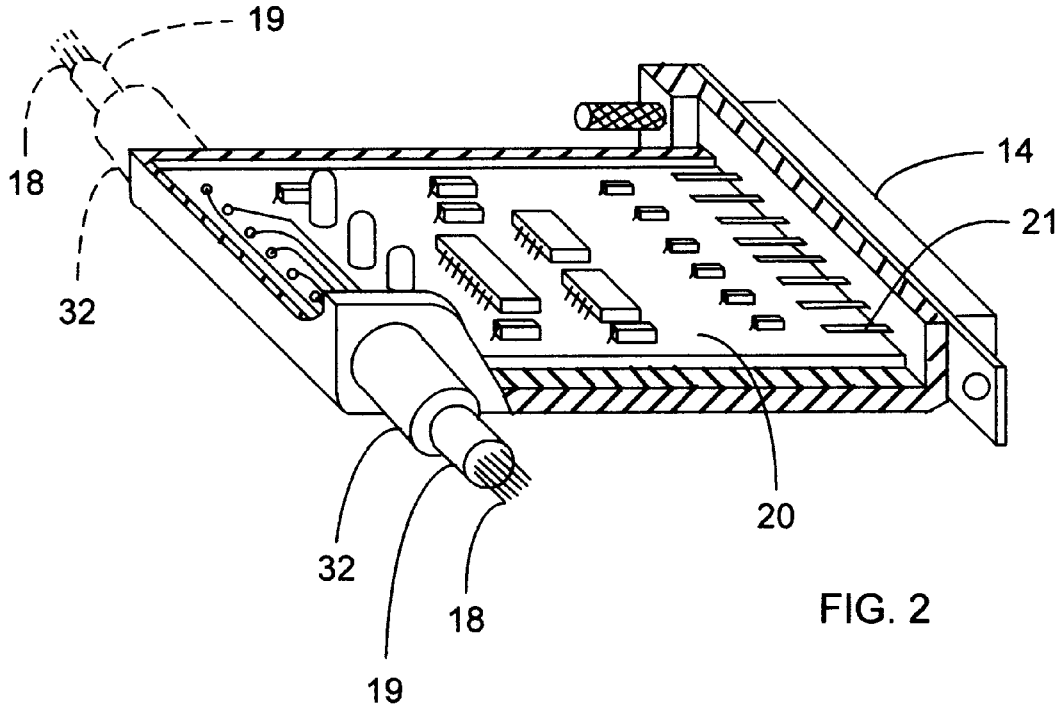
FIG. 2 is a perspective cut-away view of a molded controller connector in accordance with the present invention.
Figure 3:
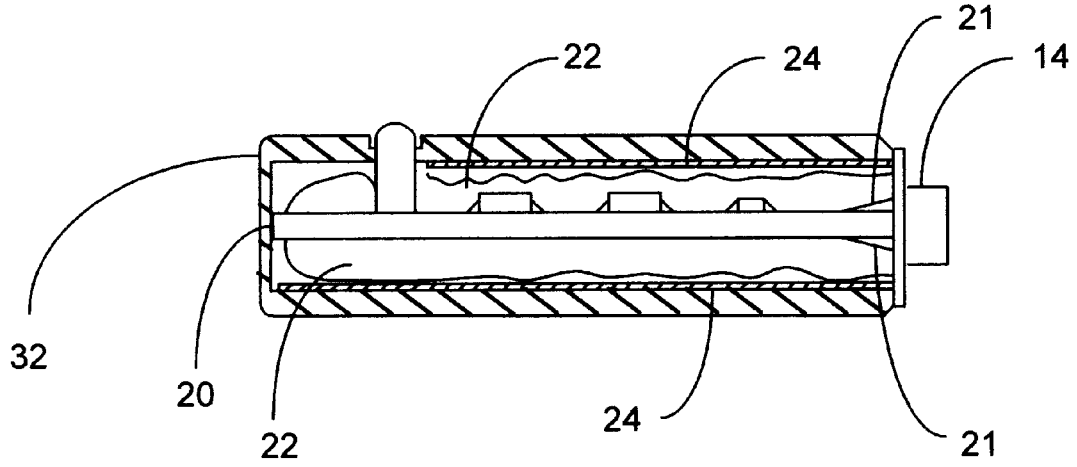
FIG. 3 is a partial cross-sectional view of a molded controller connector in accordance with the present invention.
Figure 4:
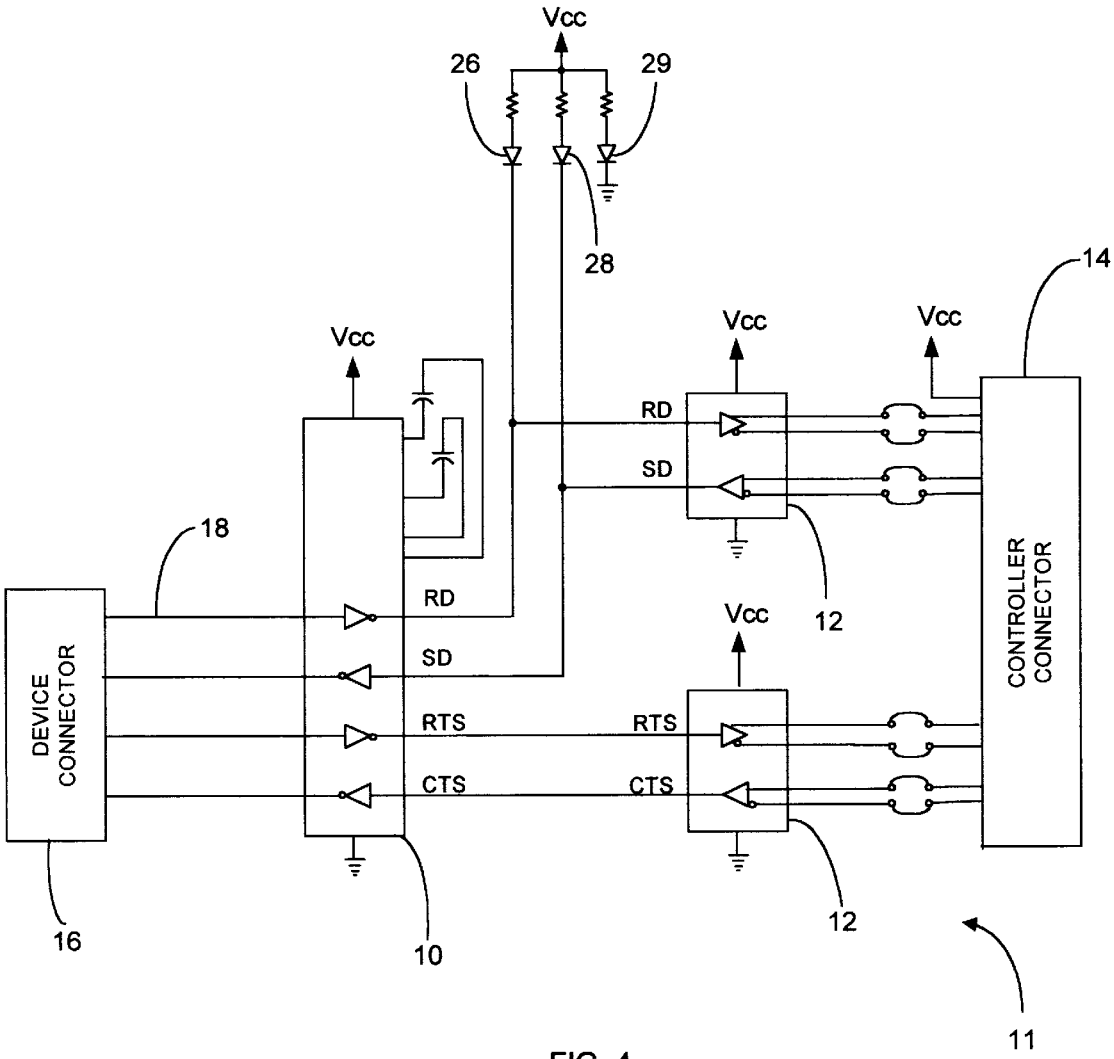
FIG. 4 is a partial schematic diagram of the electrical circuitry for the voltage level conditioning transceiver cable in accordance with the present invention.

With reference now to the drawings, and particularly to FIG. 1, there is shown a perspective view of a voltage level conditioning transceiver cable 1. With reference to FIGS. 2–4, the voltage level conditioning transceiver cable 1 includes a voltage level conditioning circuit 10, a single ended to differential circuit 12, a controller connector 14, a device connector 16, and a plurality of lines 18. The voltage level conditioning circuit 10 and the single ended to differential circuit 12 are mounted on a circuit board 20. The controller connector 14 is attached to one end of the circuit board 20. One end of a plurality of lines 18 are attached to the other end of the circuit board 20 such that they run substantially parallel to a front of the controller connector 14. The other end of the plurality of lines 18 are connected to the pins of the device connector 16. The other end of the plurality of lines 18 and the device connector 16 are encapsulated in plastic to form a molded device cover 34 to protect thereof from damage and moisture. The plurality of lines 18 are wrapped in a metal shield and retained in a protective sheath 19. The plurality of lines 18 and the protective sheath 19 are commonly referred to as a cable. The metal shield is preferably ferrous to prevent both reception and transmission of spurious electric and magnetic signals. The metal shield is coupled to the ground pin of the controller connector through a metal foil 24.

The top and bottom of the circuit board 20 is preferably coated with a silicon material 22. The metal foil 24 is wrapped around the silicon material 22 which acts as an insulator to the metal foil 24. The metal foil 24 is connected to the ground pin of the programmable controller. The metal foil 24 is preferably ferrous to prevent both reception and transmission of spurious electric and magnetic signals.

After application of the silicon 22 and metal foil 24, the circuit board 20 and the protective sheath 19 are placed in a plastic mold. The circuit board 20, the controller connector 14 and protective sheath 19 are encapsulated in plastic to form a molded controller cover 32 to protect thereof from damage and moisture. A plurality of ridges 30, substantially perpendicular to the front of the controller connector 14 are created as part of the controller cover 32. The plurality of ridges 30 make it easier to withdraw the controller connector 14 from a RS-485/RS-422 communication port on a programmable controller.

The plurality of lines 18 and protective sheath 19 drawn dashed may be disposed 180 degrees opposite the plurality of lines 18 and protective sheath 19 drawn solid. The two orientations of the plurality of lines 18 are needed for different orientations of the RS-485/RS-422 communication port on a programmable controller.

The device connector 16 may be connected to a personal computer, an operator interface terminal, or a modem. The personal computer requires that the device connector 16 be a nine pin connector. The operator interface terminal and the modem require that the device connector 16 be a 25 pin connector.

FIG. 4 shows a partial schematic diagram of the voltage level transceiver circuit 11. A partial schematic diagram of the voltage level transceiver circuit 11 is shown to make understanding easier. Preferably, a Maxim part no. MAX202E transceiver integrated circuit is used for the voltage level conditioning circuit 10. Preferably, two Maxim part no. MAX490E RS-485/RS-422 transceiver integrated circuits are used for the single ended to differential circuit. Two integrated circuits are used for circuit board layout reasons. A single Maxim part no. MAX489E could used to replace the two Maxim part no. MAX490E integrated circuits. The voltage level transceiver circuit 10 converts the RS-232 compatible signal levels of −12 to +12 volt input of the receive data (RD) and the request to send (RTS) signals into a TTL/CMOS compatible voltage level. The voltage level conditioning circuit 10 also converts the TTL/CMOS compatible send data (SD) and clear to send (CTS) single ended signals into RS-232 compatible differential signals of −10 to +10 volts.

The single ended to differential circuit 12 converts the TTL/CMOS compatible receive data (RD) and request to send (RTS) signals to RS-485/RS-422 compatible differential signals. The single ended to differential circuit 12 also converts the differential send data (SD) and clear to send (CTS) RS-485/RS-422 compatible signals into single ended TTL/CMQS compatible signals. Both the voltage level conditioning circuit 10 and the single ended to differential circuit 12 are electro-static discharge protected to +/−15 kilovolts. The Maxim MAX202E, MAX490E, MAX489E are low power devices.

At least one light indication device is attached to the voltage level transceiver circuit 11. The at least one light indication device is powered by a +5 volt output which is output on one of the controller connector pins 21. Preferably, the light indication device is a light emitting diode (LED). It is also preferable that the RD line have a receive data LED 26, that the SD line have a send data LED 28, and that the power line have a power line LED 29. The receive and send data LEDs flash when data is being transferred between the device and programmable controller. The SD and RD lines are normally high. The power LED 29 monitors the +5 volt output of a programmable controller.

The +5 volt output of the programmable controller is sufficient to power the receive data LED 26, the send data LED 28, the power line LED 29, the voltage level conditioning circuit 10, and the single ended to differential circuit 12.

The height of the LEDs are critical for encapsulating the circuit board 20. If the LEDs are too short, the molded plastic 32 will flow over the top of the LED. If the LED is too tall, the shut off pin will crush the LED. Applicant believes that no adapter or cable exists which has LEDs retained by plastic molding. Some adapters exist which protect the LED with a snap on plastic cover, but not plastic encapsulation.

The RD, RTS, SD, and CTS differential lines may be connected to the pins of the controller connector 14 with opto-couplers. The opto-couplers prevent noise from traveling from the programmable controller to the device or vice-versa. Extra surge devices may also be placed where the opto-couplers could be placed.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A voltage level conditioning transceiver cable comprising:

a controller connector having a single connector face;

a single ended to differential circuit being connected to said controller connector;

a voltage level conditioning circuit being connected to said single ended to differential circuit, said single ended to differential circuit and said voltage level conditioning circuit being mounted on a circuit board;

a cable having one end connected to said voltage level conditioning circuit, said cable being disposed substantially perpendicular to a plurality of pins of said controller connector;

at least one light indication device being connected between said voltage level conditioning circuit and said single ended to differential circuit, said at least one light indication device emitting light during the transfer of data;

said circuits being covered with an insulating material, a metal foil being wrapped around said insulating material, said metal foil being connected to a ground pin of said controller connector, said controller connector, said metal foil, said circuits, and said cable being encapsulated in a single-shell housing during a plastic molding operation, a top of said at least one light indication device not being molded over; and a device connector being connected to the other end of said cable, said device connector being encapsulated in a plastic molding operation.

2. The voltage level conditioning transceiver cable of claim 1, further comprising:

said insulation material being silicone.

3. The voltage level conditioning transceiver cable of claim 1, further comprising:

an opto-coupler optically connecting each data line or each data control line from said controller connector to said single ended to differential circuit.

4. The voltage level conditioning transceiver cable of claim 1, further comprising:

a power line light indication device being connected to a power output pin of a programmable controller, said power line light indication device emitting light when the power output pin is sourcing power.

5. The voltage level conditioning transceiver cable of claim 1, wherein:

a plurality of lines extending from said cable, said plurality of lines being wrapped in a metal shield which is coupled to a ground pin of said controller connector.

6. A voltage level conditioning transceiver cable comprising:

a controller connector having a single connector face;

a single ended to differential circuit being connected to said controller connector;

a voltage level conditioning circuit being connected to said single ended to differential circuit;

a cable having one end connected to said voltage level conditioning circuit, said cable being disposed substantially perpendicular to a plurality of pins of said controller connector;

at least one light indication device emitting light during the transfer of data in either of said circuits; and said circuits being covered with an insulating material, a metal foil being wrapped around said insulating material, said metal foil being connected to a ground pin of said connector, said connector, said metal foil, said circuits, and an end of said cable being encapsulated in a single-shell housing during a plastic molding operation, a top of said at least one light indication device not being molded over by maintaining each said light indication device at a consistent height relative to each said circuit board before overmolding.

7. The voltage level conditioning transceiver cable of claim 6, further comprising:

a device connector being connected to said voltage level conditioning circuit.

8. The voltage level conditioning transceiver cable of claim 6, further comprising:

said device connector being encapsulated in a plastic molding operation.

9. The voltage level conditioning transceiver cable of claim 6, further comprising:

said insulation material being silicone.

10. The voltage level conditioning transceiver cable of claim 6, further comprising:

an opto-coupler optically connecting each data line or each data control line from said controller connector to said single ended to differential circuit.

11. The voltage level conditioning transceiver cable of claim 6, further comprising:

a power line light indication device being connected to a power output pin of a programmable controller, said power line light indication device emitting light when the power output pin is sourcing power.

12. The voltage level conditioning transceiver cable of claim 6, wherein:

a plurality of lines extending from said cable, said plurality of lines being wrapped in a metal shield which is coupled to a ground pin of said controller connector.

13. A voltage level conditioning transceiver cable comprising:

a controller connector having a single connector face;

a single ended to differential circuit being connected to said controller connector;

a voltage level conditioning circuit being connected to said single ended to differential circuit;

a cable having one end connected to said voltage level conditioning circuit, said cable being disposed substantially perpendicular to a plurality of pins of said controller connector;

at least one light indication device emitting light during the transfer of data in either of said circuits; and said circuits being covered with an insulating material, a metal foil being wrapped around said insulating material, said metal foil being connected to a ground pin of said connector, said connector, said metal foil, said circuits, and an end of said cable being encapsulated in a single-shell housing during a plastic molding operation, a top of said at least one light indication device not being molded over.

14. The voltage level conditioning transceiver cable of claim 13, further comprising:

a device connector being connected to said voltage level conditioning circuit.

15. The voltage level conditioning transceiver cable of claim 13, further comprising:

said device connector being encapsulated in a plastic molding operation.

16. The voltage level conditioning transceiver cable of claim 13, further comprising:

said insulation material being silicone.

17. The voltage level conditioning transceiver cable of claim 13, further comprising:

an opto-coupler optically connecting each data line or each data control line from said controller connector to said single ended to differential circuit.

18. The voltage level conditioning transceiver cable of claim 13, further comprising:

a power line light indication device being connected to a power output pin of a programmable controller, said power line light indication device emitting light when the power output pin is sourcing power.

19. The voltage level conditioning transceiver cable of claim 13, wherein:

a plurality of lines extending from said cable, said plurality of lines being wrapped in a metal shield which is coupled to a ground pin of said controller connector.

* * * * *